US005619768A

United States Patent [19]

Brundula et al.

[11] Patent Number: 5,619,768

[45] Date of Patent: Apr. 15, 1997

[54] VACUUM SWEEPER BRUSH AND CONCENTRIC ROLLER PIN

[75] Inventors: Rudolph F. Brundula, Gates Mills; William P. Brundula, Kirtland, both of Ohio

[73] Assignee: Bruns Brush, Inc., Willoughby, Ohio

[21] Appl. No.: 495,301

[22] Filed: Jun. 28, 1995

[51] Int. Cl.[6] ..... A46B 13/02

[52] U.S. Cl. ..... 15/179; 15/41.1; 15/391; 15/392; 29/444; 29/509; 29/512

[58] Field of Search ..... 15/41.1, 42, 43, 15/44, 45, 46, 47, 48, 48.1, 48.2, 179, 181, 182, 183; 29/509, 512, 444, 898.07; 492/47

[56] References Cited

U.S. PATENT DOCUMENTS

| | | | |
|---|---|---|---|
| 3,828,387 | 8/1974 | Liebscher | 15/182 |
| 3,971,115 | 7/1976 | Schneider | 492/47 |
| 5,134,744 | 8/1992 | Ji | 15/179 |
| 5,193,243 | 3/1993 | Stegens | 15/41.1 |
| 5,249,328 | 10/1993 | Shin | 15/182 |
| 5,272,785 | 12/1993 | Stegens | 15/179 |
| 5,373,603 | 12/1994 | Stegens | 15/41.1 |
| 5,435,038 | 7/1995 | Sauers | 15/179 |
| 5,452,490 | 9/1995 | Brundula | 15/182 |
| 5,465,451 | 11/1995 | Stegens | 15/41.1 |

*Primary Examiner*—Charles E. Cooley
*Assistant Examiner*—Randall Chin
*Attorney, Agent, or Firm*—Woodling, Krost & Rust

[57] ABSTRACT

A concentric roller pin for use in combination with a roller member of a vacuum cleaner wherein the concentric roller pin includes an inner end, an outer end and an intermediate portion. The inner end of the concentric roller pin is tapered and terminates in a transverse face. The transverse face of the concentric roller pin abuts a corresponding face in a tapered bore of the roller member. The intermediate portion of the concentric roller pin includes an outer knurled surface for securing the concentric roller pin to the roller member. The outer end of the concentric roller pin includes a bearing surface, a bearing lip, an axial indentation, and a beveled edge surrounding the axial indentation. The axial indentation and beveled edge of the outer end of the concentric roller pin facilitates deformation thereof for securing a bearing against the bearing lip and the bearing surface.

6 Claims, 11 Drawing Sheets

VACUUM SWEEPER BRUSH AND CONCENTRIC ROLLER PIN

FIELD OF THE INVENTION

This invention relates to vacuum sweeper brushes and in particular a vacuum sweeper brush in combination with a concentric roller pin. The concentric roller pin of the instant invention is unique in that it provides for a stable, smooth running sweeper brush.

BACKGROUND OF THE INVENTION

Vacuum sweeper brushes and roller pins are known. However, the concentric roller pin in combination with the brush as herein described is unique. Roller pins heretofore used typically employ a large sleeve on the outer end or intermediate portions thereof. This sleeve has the disadvantage of engaging the roller brush resulting in some instances where the inner end of the roller pin does not fully engage the bore in the sweeper brush. The present invention does not employ a flanged surface.

Roller pins are inserted in both ends of the sweeper brush. Roller pins function as bearing mounts for attachment to the vacuum sweeper. Additionally, the roller pins heretofore used are not concentric having up to 0.018 inch runout resulting in roller brush wobble or instability.

In particular the present invention employs a cold-headed roller pin and a bearing which is staked onto the outer end of the pin. The cold headed roller pin of the present invention is advantageously concentric. In particular, the roller pin has an inner center and an outer center which are concentric with total runout less than 0.002 inches. Additionally, the present invention permits the roller pin to bottom out and positively engage the roller brush. This is an extremely simple construction which enables the speedy and economical manufacture of the roller brush and roller pin combination. The roller brush and roller pin assemblies of the present invention are stable, and well aligned.

SUMMARY OF THE INVENTION

It is an object of the present invention to provide a vacuum brush in combination with a generally cylindrical and concentric roller pin which enables a smooth running vacuum sweeper brush. This is accomplished by the use of a concentric cold headed pin which is accurately inserted into the vacuum sweeper brush and which does not have an interfering flange on the roller pin.

It is a further object of the present invention to provide a vacuum sweeper brush which is simple and efficient to manufacture.

It is a further object of the invention to provide a vacuum sweeper brush which employs a concentric roller pin having a bearing lip, a bearing surface and a deformable outer end.

It is a further object of the invention to provide a sweeper brush in combination with a concentric roller pin having a bearing secured thereon by means of staking the outer end of the concentric roller pin. The outer end may be single staked or may be cross-staked numerous times. Additionally, it is an object of the present invention to provide a concentric roller pin having a bearing secured thereon by means of press fitting the bearing onto a knurled surface of the pin.

It is a further object of the present invention to provide a roller pin which includes an inner and an outer end and an intermediate portion. The inner end of the roller pin is tapered and terminates in a transverse face or plane. The transverse face or plane engages a corresponding surface in a bore of the roller member. The outer end of the roller pin includes a bearing surface, a bearing lip and an axial, generally conically shaped, indentation. The axial indentation is staked, peened or riveted to hold the bearing to the roller pin.

It is a further object of the invention to provide a concentric roller pin in combination with a roller member which is smooth running and has minimal vibration. Further, it is an object of the invention to provide a concentric roller pin with runout of less than 0.002 inches.

BRIEF DESCRIPTION OF THE DRAWINGS

FIG. 1A indicates knurled surface 28 on the outer end portion thereof.

The drawings, which have been briefly described above, will be better and more fully understood as described hereinbelow in connection with the description of the preferred embodiment of the invention.

DESCRIPTION OF THE PREFERRED EMBODIMENT

Figure 1:
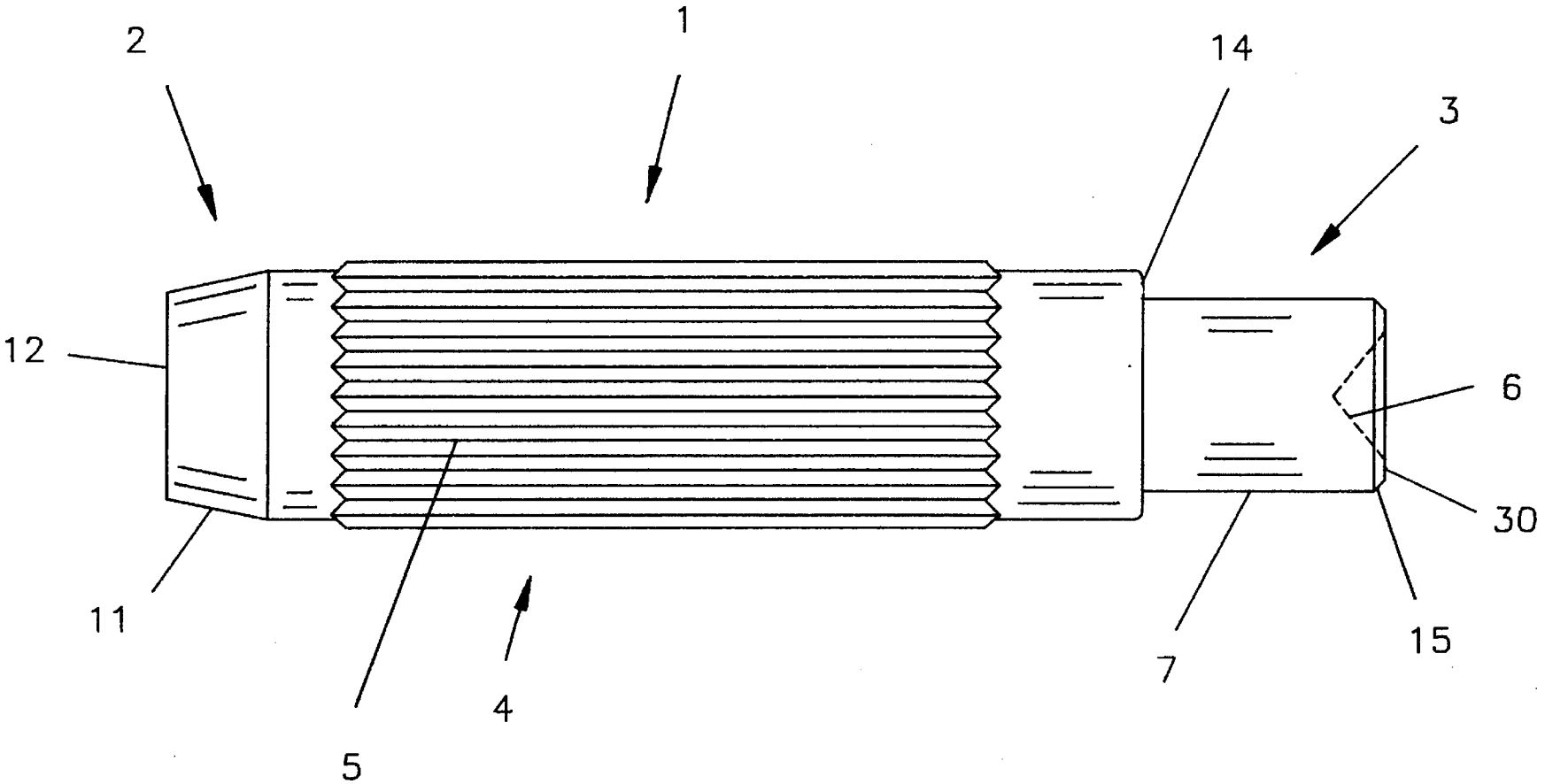
FIG. 1 is an enlarged view of the concentric roller pin illustrating the inner end, outer end and intermediate portions thereof.

FIG. 1 illustrates an enlarged view of the roller pin 1. The roller pin is generally cylindrically shaped. The concentric roller pin 1 includes the inner end 2, the intermediate portion 4, and the outer end 3. As best seen from FIG. 1, the outer end 3 includes a bearing lip 14, a bearing surface 7, and an axial, generally conically shaped, indentation 6. Additionally, the outer end 3 includes beveled edge 15 and crown 30.

Figure 1A:
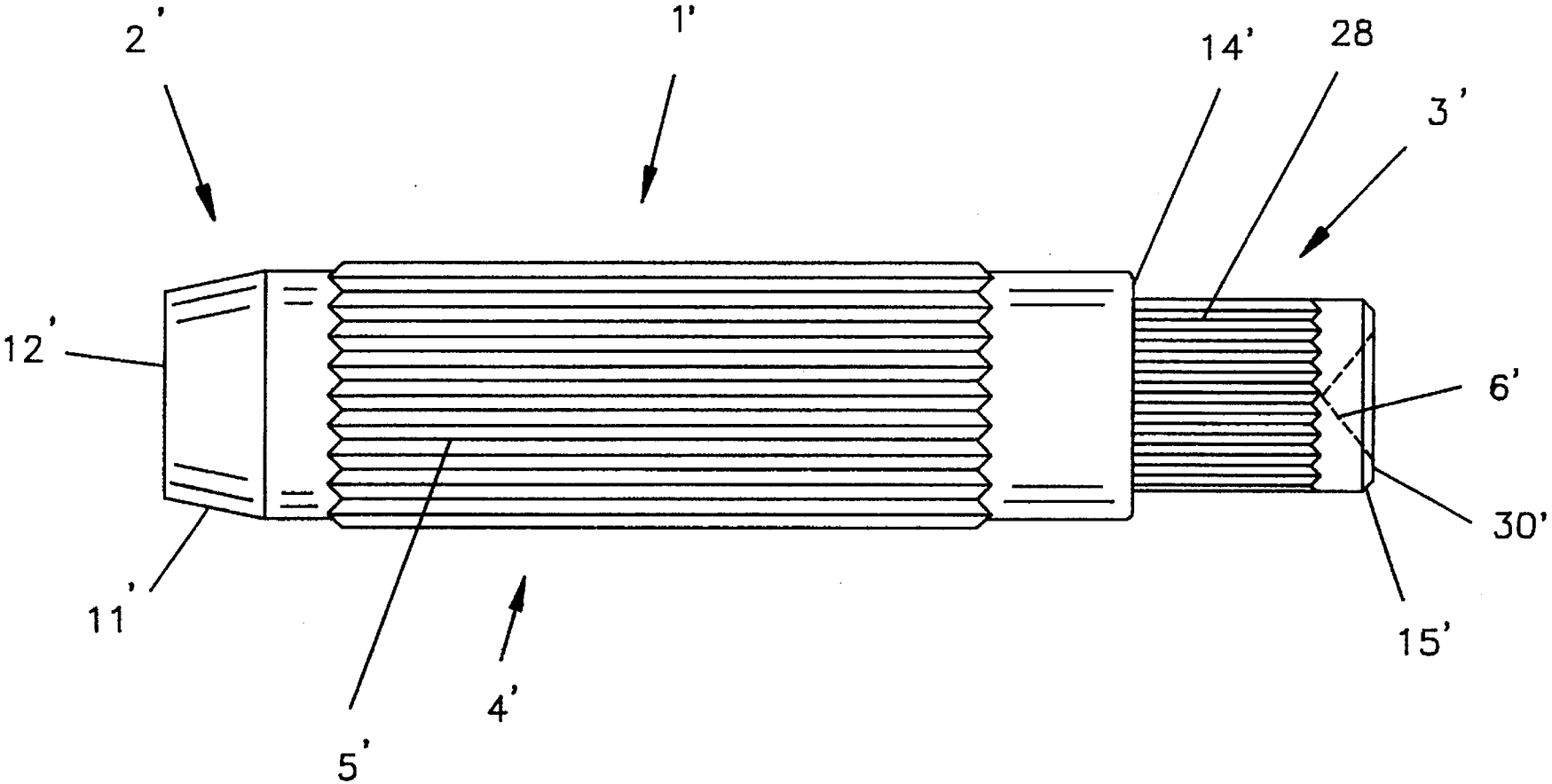
FIG. 1A is an enlarged view of another embodiment of the concentric roller pin.
Figure 2A:
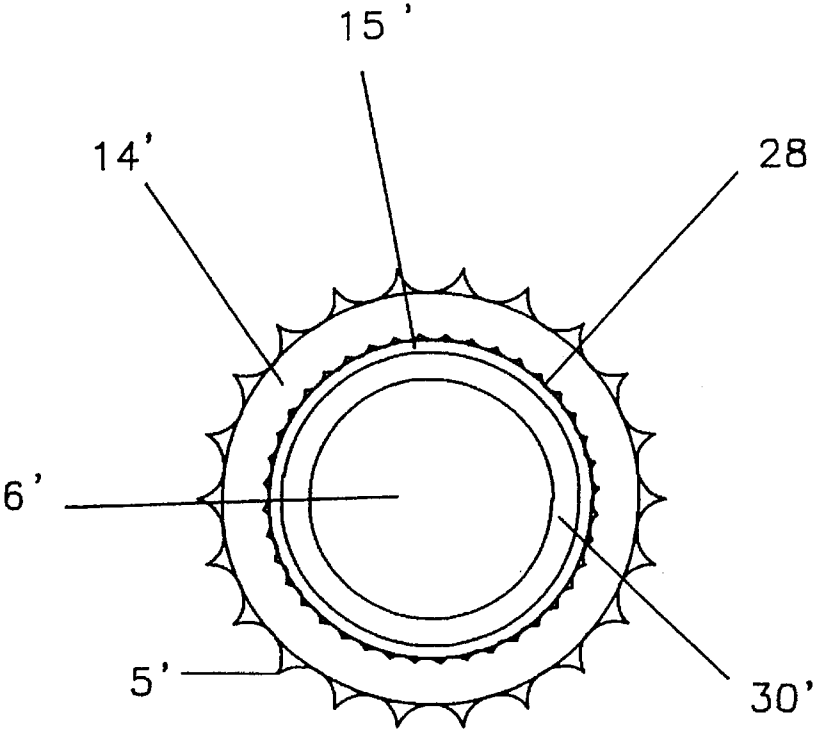
FIG. 2A is an enlarged side view of the embodiment of the concentric roller pin 1' corresponding to FIG. 1A illustrating the outer end 3'. The outer end 3' has a knurled surface 28 on the outer end thereof for affixing a bearing thereto.

FIG. 1A is an enlarged side view of another embodiment of the concentric roller pin 1' illustrating the outer end 3'. FIG. 2A illustrates a knurled surface 28 on the outer end thereof for affixing a bearing thereto. The concentric roller pin 1' includes the inner end 2', the intermediate portion 4' and the outer end 3'. The outer end 3' includes a bearing lip 14', a knurled bearing surface 28, and an axial, generally conically shaped, indentation 6'. Additionally, the outer end 3' includes beveled edge 15' and crown 30'. FIG. 1A depicts a concentric roller pin identical to that shown in FIG. 1 except for knurled bearing surface 28.

Figure 4:
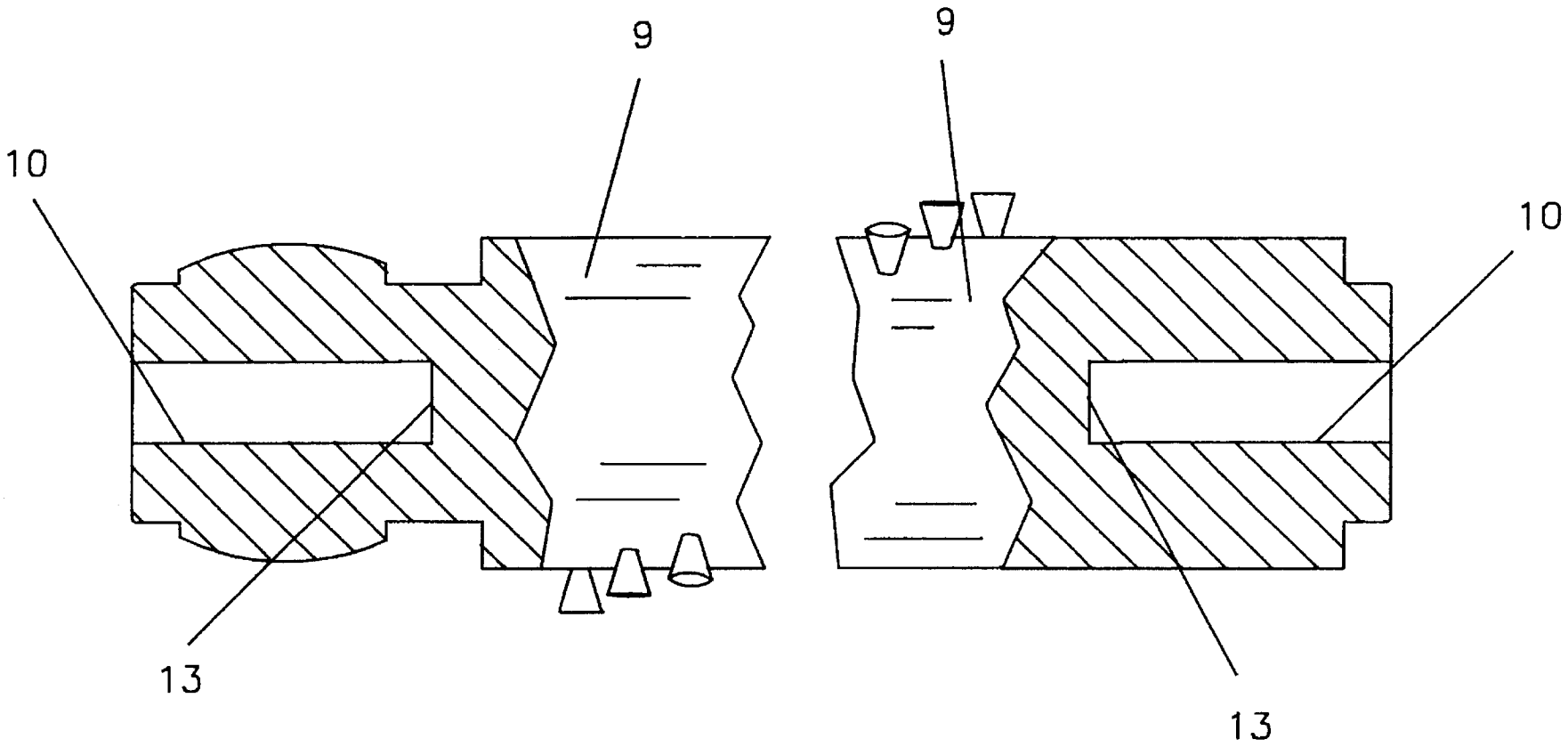
FIG. 4 is a plan view, shown partly in section, of the vacuum sweeper brush illustrating the bores therein.
Figure 5:
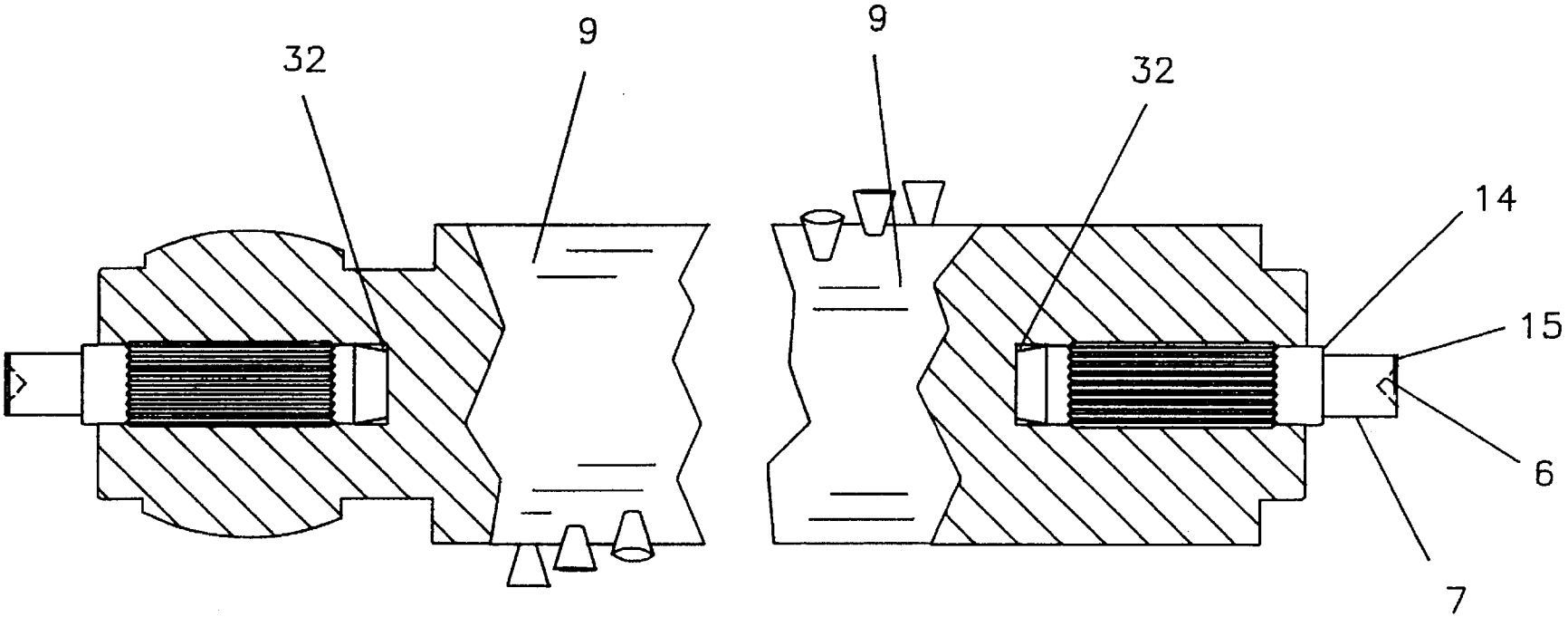
FIG. 5 is a plan view, shown partly in section, of the vacuum sweeper brush similar to FIG. 4 illustrating the concentric roller pins in the sweeper brush.

The inner end 2 of the concentric roller pin 1 includes a tapered surface 11 and a face 12. The face 12, or transverse surface as sometimes referred to herein, is perpendicular to the axis of the roller pin 1. The intermediate portion 4 of the roller pin is knurled 5. The intermediate portion is knurled for the purpose of securing the roller pin 1 with respect to the roller member 9. Roller member 9 is illustrated in FIGS. 4 and 5.

Similarly, in FIG. 1A, inner end 2' of the concentric roller pin 1' includes a tapered surface 11' and a face 12'. The face 12' is perpendicular to the axis of the roller pin 1'. The intermediate portion is knurled for the purpose of securing the roller pin 1' with respect to the roller member 9. Roller member 9 is illustrated in FIGS. 4 and 5.

Figure 2:
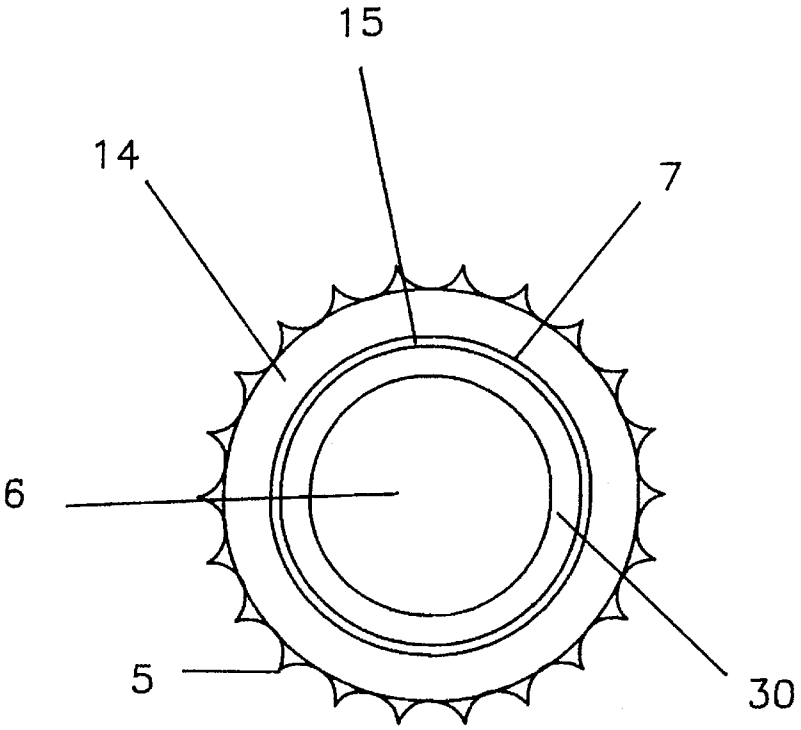
FIG. 2 is an enlarged side view of the concentric roller pin 1 illustrating the outer end thereof. The axial, generally conically shaped, deformable indentation is also illustrated.

FIG. 2 is an enlarged side view of the concentric roller pin 1 illustrating the outer end 3. FIG. 2 illustrates the axial indentation 6. Also illustrated in FIG. 2 is the bearing lip 14 as well as the knurled surface 5 of the intermediate portion 4 of the roller pin 1. FIG. 2 also illustrates the crown 30 and beveled edge 15 of the inner end.

FIG. 2A is an enlarged side view of the concentric roller pin 1' illustrating the outer end 3'. FIG. 2A illustrates the axial indentation 6'. Also illustrated in FIG. 2A is the bearing lip 14' as well as the knurled surface 5' of the intermediate portion 4' of the roller pin 1'. FIG. 2A also illustrates the knurled bearing surface 28 which secures a bearing which is pressed onto the concentric roller pin 1'. FIG. 2A also illustrates the crown 30' and beveled edge 15' of the inner end.

Figure 3A:
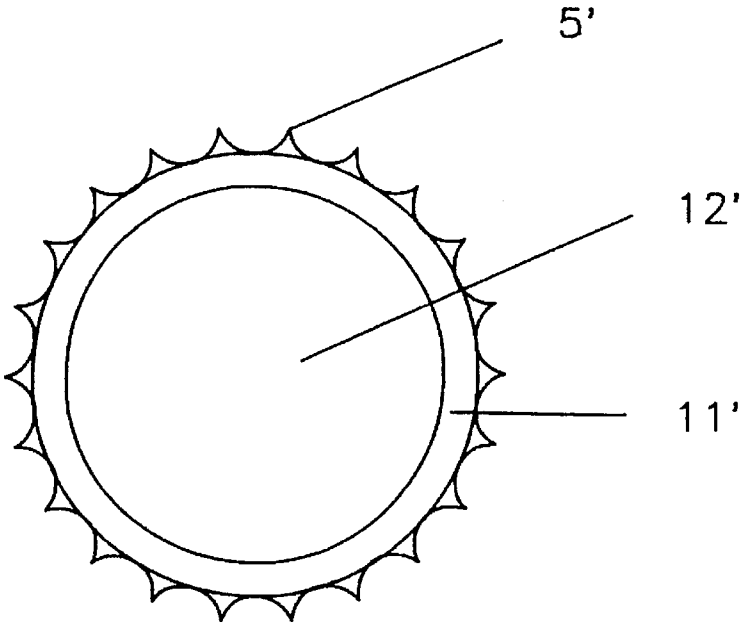
FIG. 3A is all enlarged side view of the concentric roller pin 1' illustrating the inner end thereof.
Figure 3:
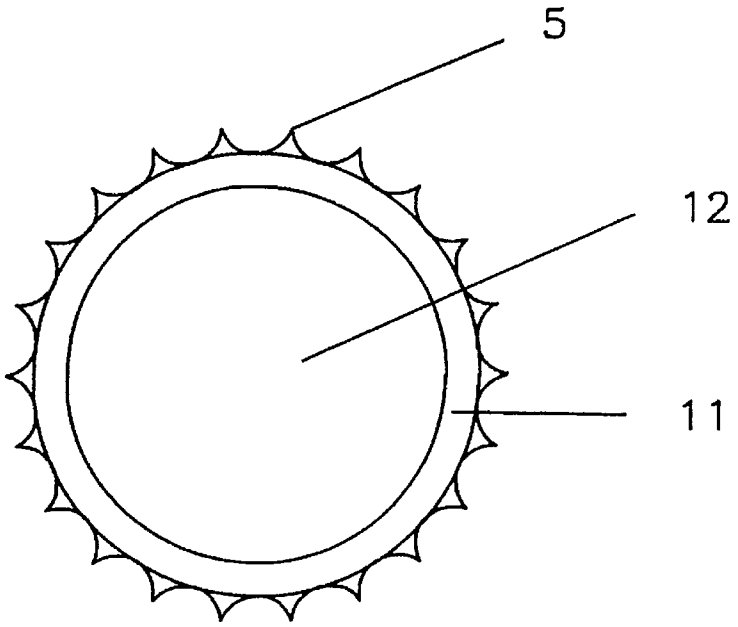
FIG. 3 is an enlarged side view of the concentric roller pin 1 illustrating the opposite end view, namely, the inner end thereof.

FIG. 3 is an inner end view of the roller pin 1. FIG. 3 illustrates the flat face 12, the tapered surface 11, and the knurl 5 on the intermediate portion 4.

FIG. 3A is an inner end view of the roller pin 1'. FIG. 3 illustrates the flat face 12', the tapered surface 11', and the knurl 5' on the intermediate portion 4'.

FIG. 4 is a plan view, shown partly in section, of the vacuum sweeper brush illustrating the bores 10 therein. The bores 10 receive the concentric roller pin 1. The bores 10 are slightly smaller in diameter than the roller pin 1. This is to facilitate the knurled surface and its engagement with the material, whether it be of wood or some other substance, of the roller member. The roller pin 1 is inserted into the roller brush 9 as shown in FIG. 5. The knurled surface 5 on the intermediate portion 4 of the roller pin 1 engages the roller brush 9. This prevents movement of the roller pin with respect to the roller brush. The roller pin rotates with the roller brush during operation of the vacuum sweeper. It will also be noted from a review of FIG. 5 that the roller pin bottoms out against, or engages, the bore at a point where the bore terminates. In other words, face 12 of the inner portion 2 of the roller pin 1 engages the corresponding flat face 13 in the roller member 9. It will noted in FIG. 5 that a gap 32 exists between the pin 1 and the bore 10 of the roller member 9.

It will be noted that the corresponding surfaces for the embodiment of the concentric roller pin 1A depicted in FIGS. 1A, 2A and 3A engage the roller brush in the same way as described in connection with FIGS. 1, 2 and 3.

Figure 6:
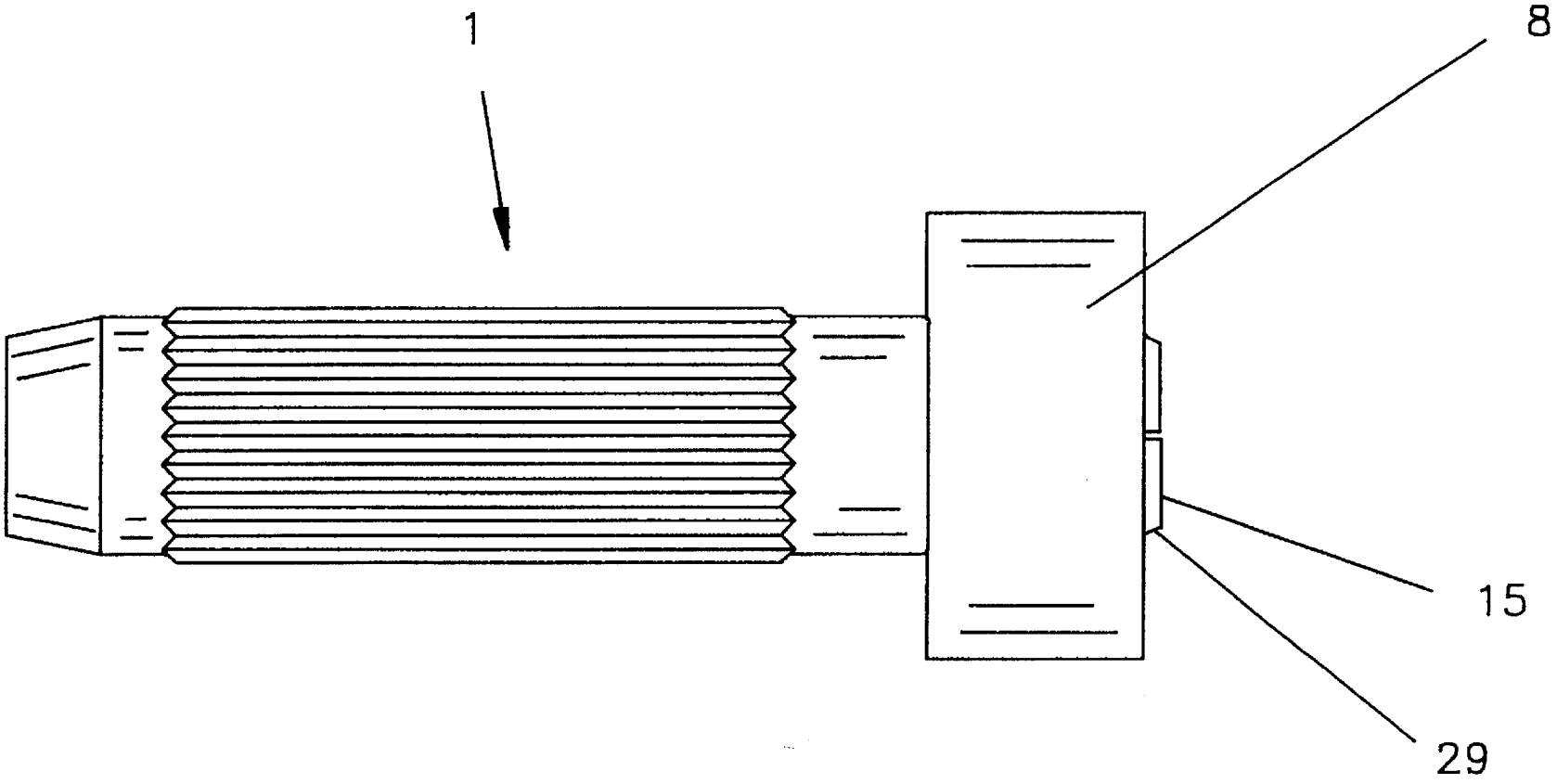
FIG. 6 is a plan view of the concentric roller pin illustrating a bearing staked onto the concentric roller pins.

FIG. 6 is a plan view of the concentric roller pin 1 illustrating a bearing 8 staked onto the roller pin 1. The staking is facilitated by the unique construction of the outer end of the roller pin. By staking it is meant that the roller pin is impacted such that the beveled edge 15 and crown 30 surrounding the axial indentation 6 is enlarged in diameter such that the bearing may not escape or slide off of the bearing surface 7 of the roller pin 1. Reference numeral 29 indicates the expansion of the beveled edge in FIG. 6. The bearing 8 is secured into position so that it may not move laterally or rotatably with respect to the roller pin 1. The bearing is held in place, with respect to the roller pin 1, by the bearing lip 14, the bearing surface 7, and the beveled edge 15 and crown 30 which have been deformed.

Figure 6A:
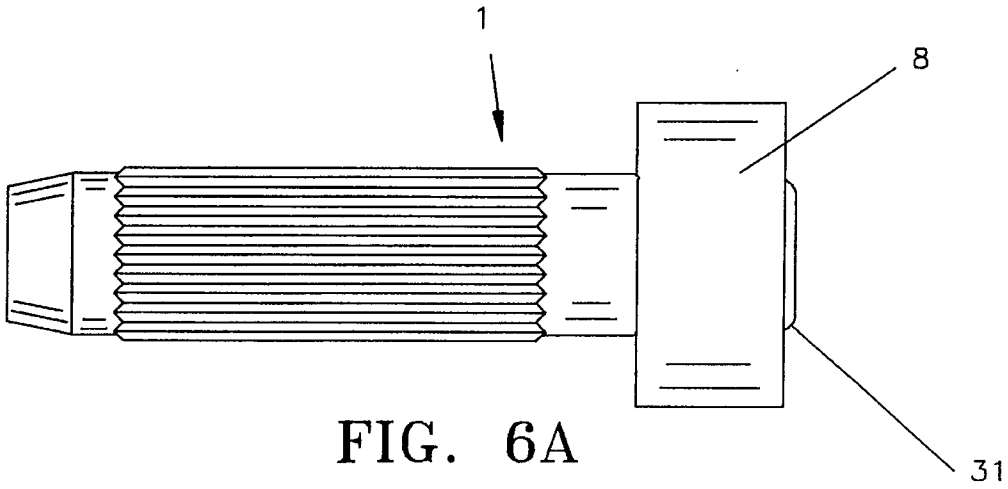
FIG. 6A is a plan view of the concentric roller pin 1 illustrating a bearing 8 secured to the roller pin 1 by means of peening the outer end of the roller pin.

FIG. 6A is a plan view of the concentric roller pin 1 illustrating a bearing 8 secured onto the roller pin 1. FIG. 6A illustrates bearing 8 affixed to the roller pin 1 by means of peening the outer end of the roller pin and crown 30. FIG. 6A also illustrates the beveled edge expanded radially outwardly to secure the bearing 8 to the concentric roller pin. Reference numeral 31 indicates the expansion of the beveled edge in FIG. 6A.

Figure 6B:
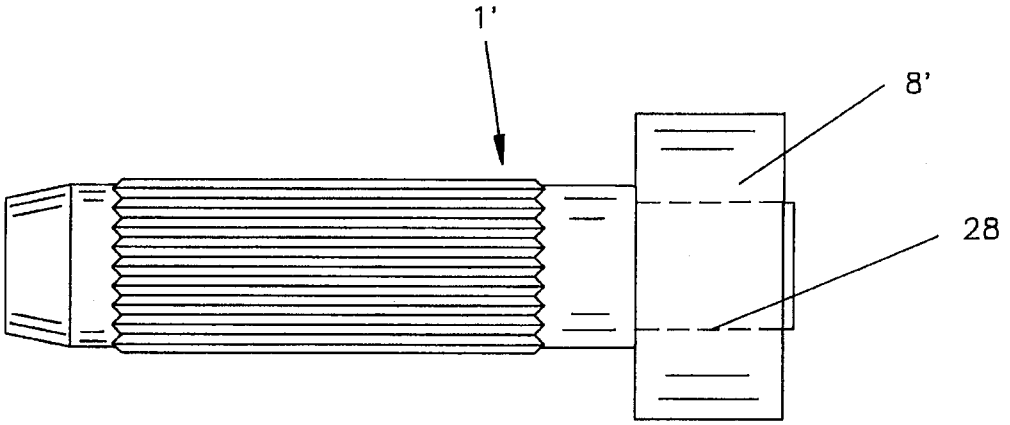
FIG. 6B is a plan view of the concentric roller pin 1' illustrating a bearing 8' pressed onto the roller pin 1' over knurled surface 28.

FIG. 6B is a plan view of the concentric roller pin 1' illustrating a bearing 8' secured to the roller pin 1' by means of a press fit over knurled surface 28.

Figure 7A:
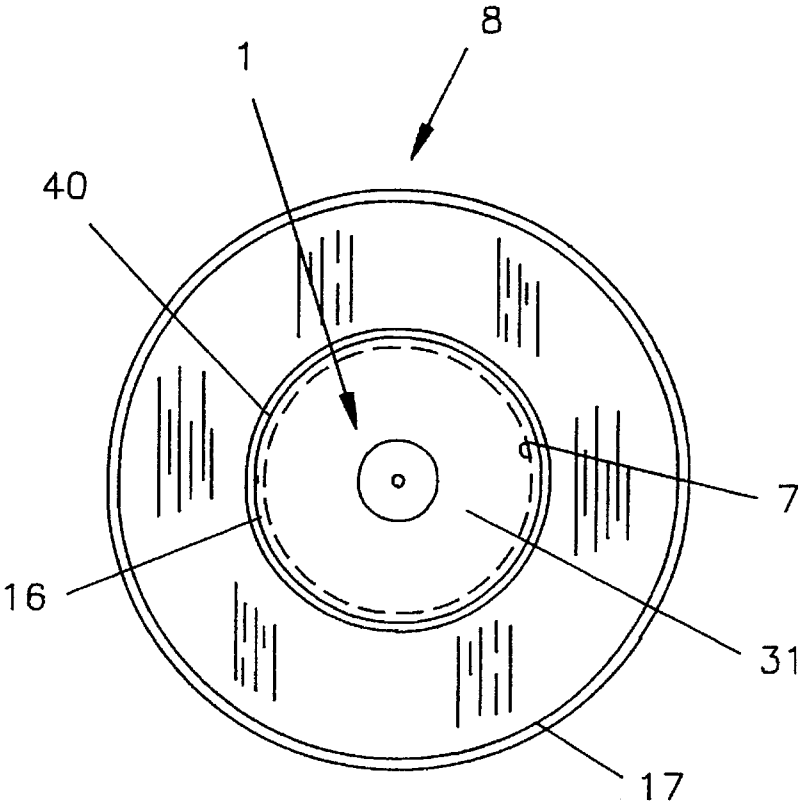
FIG. 7A is an enlarged side view of the outer end of one of the roller pins and the bearing illustrating the beveled edge and crown expanded by peening or riveting.
Figure 7:
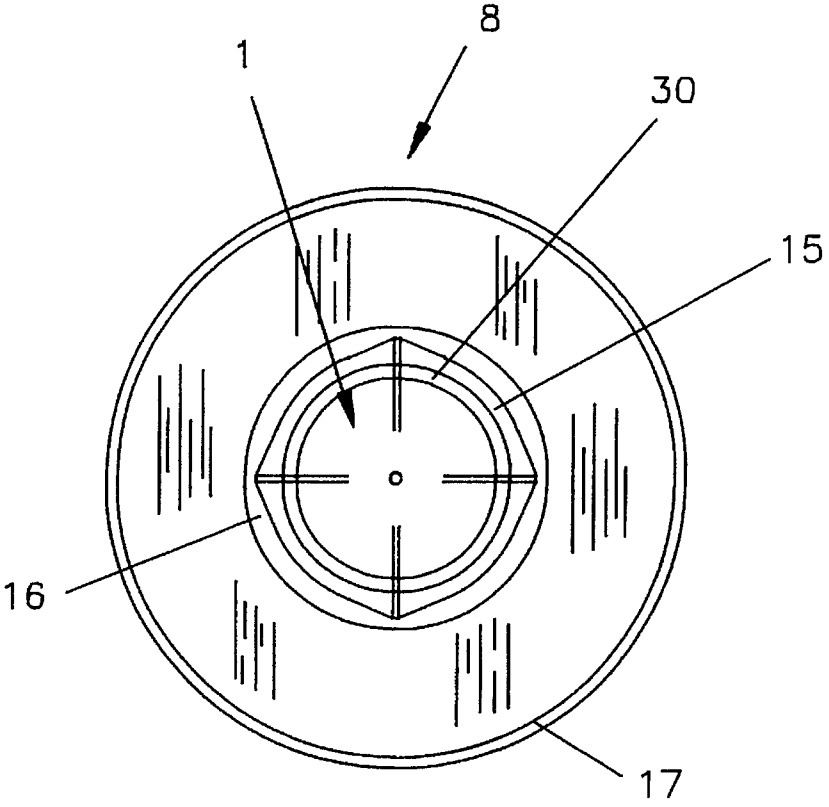
FIG. 7 is an enlarged side view of the outer end of the concentric roller pin and bearing illustrating the bearing staked onto the concentric roller pin.

FIG. 7 is an enlarged side view of the outer end of the concentric roller pin 1 and the bearing illustrating the beveled edge 15 and crown 30 expanded by means of cross-staking, thereby securing the bearing onto the roller pin. The beveled edge 15 and crown 30 may be expanded or deformed by means of single staking.

FIG. 7A is an enlarged side view of the outer end of one of the roller pins and the bearing illustrating the beveled edge and crown expanded by peening. Reference numeral 31 indicates the expansion inwardly and reference numeral 40 indicates the expansion outwardly of the beveled edge and crown by peening the outer end of the concentric roller pin.

Figure 8:
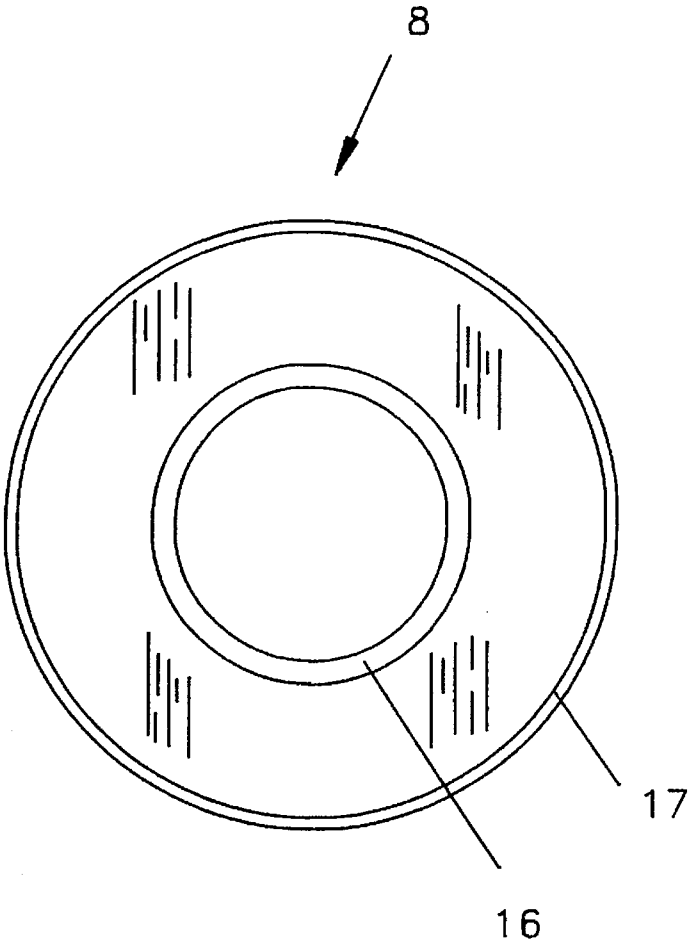
FIG. 8 is an enlarged side view of the bearing illustrating the inner ring and outer ring thereof.

FIG. 8 is an enlarged side view of the bearing 8 illustrating the inner ring 16 and the outer ring 17 of the bearing 8. The inner ring 16 of the bearing moves with the roller pin 1 and the roller member. Roller member 9 is rotated by means which are not shown in the drawings. Roller members are typically rotated by means of a belt.

The roller pin 1 of the present invention is preferably made from a cold-headed stock. By cold-headed it is meant that the ends of the roller pin are upset by a die. By upset it is meant that the roller pin 1 is impacted, or smashed, externally so as to change the diameter of the impacted portion. The roller pin is set positively against the roller member 9. In particular, the face 12 of roller pin 1 positively engages the corresponding flat face 13 of the roller member.

The roller pin of the present invention is concentric, plus or minus 0.002 inches from the inner center 22 of the inner end 2 to the outer center 23 of the outer end 3 of the roller pin 1. See, FIG. 10 (not to scale) illustrating a small shift of the actual outer center 23 with respect to the ideal outer center 23'. The roller pin 1 of the invention is cold-headed with a single die. This enables manufacture of the roller pin 1 with a total concentric runout from the inner 22 center to outer 23 center of less than 0.002 inches.

Figure 9:
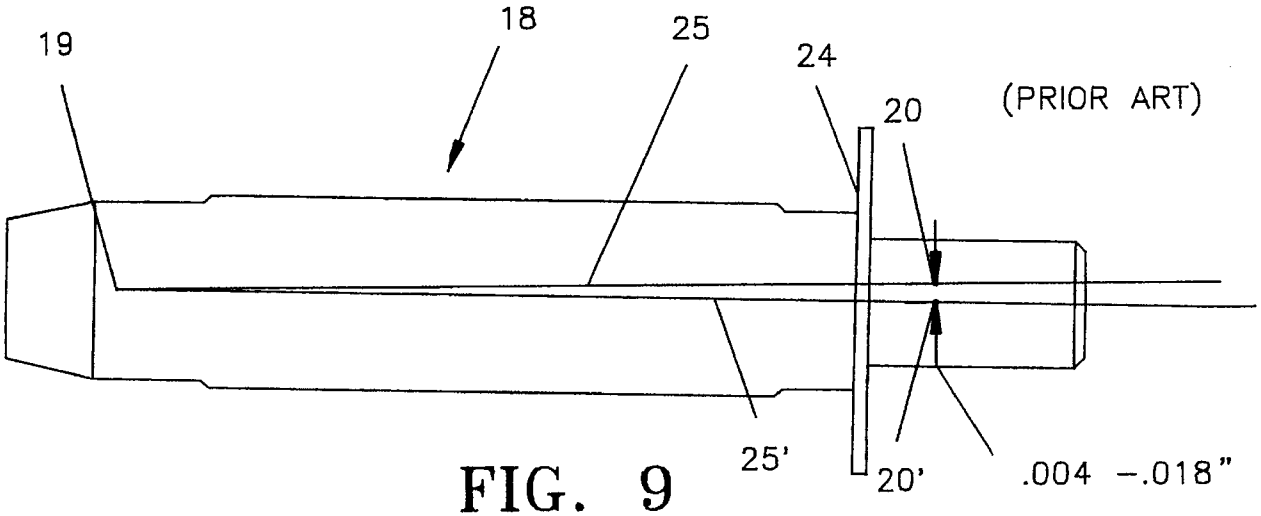
FIG. 9 is an enlarged plan view of a related art roller pin illustrating (not to scale) a runout of from 0.004 to 0.018 inches from the inner center to the outer center.

A roller pin 18 heretofore known in the art is illustrated in FIG. 9. FIG. 9 is an enlarged, not to scale, plan view of the related art roller pin 18 showing the ideal axis of rotation 25' and the actual axis of rotation 25. A runout of 0.004 to 0.018 inches is shown in FIG. 9. The concentricity, from the inner center 19 to the outer center 20, is typically in the range of 0.004 to 0.018 inches. FIG. 9 illustrates (not to scale) a relatively large shift of the actual outer center 20 with respect to the ideal outer center 20'.

Figure 10:
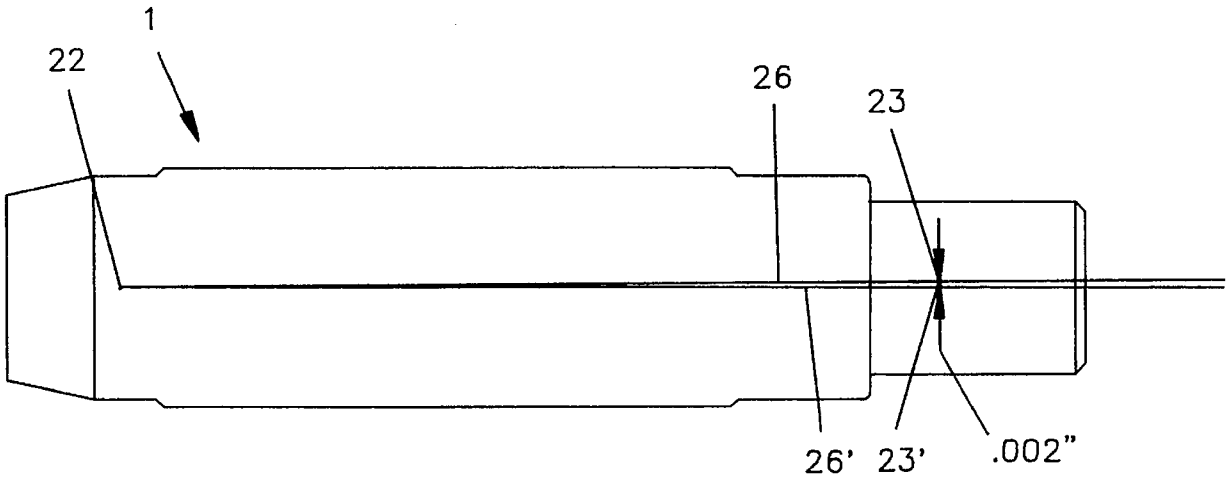
FIG. 10 is an enlarged view of the concentric roller pin of the present invention, similar to FIG. 1, illustrating (not to scale) a runout of less than 0.002 inches.

FIG. 10 is an enlarged, not to scale, plan view of the roller pin 1 of the present invention illustrating the ideal axis of rotation 26' and the actual axis of rotation 26. A runout of 0.002 inches is shown in FIG. 10. FIG. 10 is identical to that shown in FIGS. 1 and 1A and illustrates concentricity in the range of less than 0.002 inches from the inner center 22 to the outer center 23. The actual axis 26 of rotation of the concentric roller pin of the present invention is relatively close to the ideal axis of rotation 26' of the concentric roller pin 1.

The roller pin 18 known in the art is made by upsetting the ends thereof with two dies. The larger collar, or sleeve, or flange as it is variously referred to herein, is made with a separate die. The size of the collar necessitates high impact forces to upset it (form it) and this has a tendency to result in a loss of concentricity. The purpose of the collar is to provide a stop against the roller member collar. The related art roller pin has an ideal axis of rotation 25'. The related art has an actual axis of rotation 25 which causes instability.

The present invention does not utilize a collar, or flange, for alignment. Rather, the roller pin 1 is pressed into receptacle 10 until the transverse face 12 of the roller pin bottoms out, or engages, the corresponding flat face 13 of the receptacle 10. The roller member of the present invention runs smoothly due to the controlled concentricity of the roller pin 1. This tight runout tolerance enables the roller brush 9 and the roller pins 1 to rotate smoothly with minimal vibration. The outer ring 17 of the bearing 8 is fixedly held in place and is mounted to the vacuum sweeper which is not shown in any of the drawings. The mounting of the bearing to the vacuum sweeper is well-known in the art.

The outer ring 17 of the bearing does not rotate with the inner ring. Bearing 8 allows the inner ring of the bearing and the roller pin and the roller brush to rotate independently of the outer ring 17 of the bearing.

The roller pin of the present invention does not have a flange or sleeve on the intermediate or outer portions thereof. This enables the complete insertion of the roller pin into the roller brush. This insures that the face 12 of the pin does bottom or engage the corresponding surface 13 of the roller member.

It will be understood to those skilled in the art that a variety of bearings may be used in this particular application.

The invention has been described in detail with particular emphasis on the preferred embodiments thereof, but it should be understood that variations and modifications within the spirit and scope of the invention may occur to those skilled in the art to which the invention pertains.

What is claimed is:

1. A vacuum sweeper brush comprising: a roller member; a roller pin; said roller member having a bore therein; said bore terminating in a perpendicular surface; said roller pin includes an inner end, an outer end, and an intermediate portion; said inner end of said roller pin includes a face and an inner center; said outer end of said roller pin includes an outer center, a bearing lip, a bearing surface, a staked crown, a staked beveled edge, and an axial indentation; said staked crown and said staked beveled edge surround said axial indentation; said intermediate portion of said roller pin includes a knurled outer surface; said inner and outer centers being concentric, plus or minus 0.002 inches; said roller pin residing substantially in said bore of said roller member; said knurled outer surface of said roller pin fixedly securing said roller pin with respect to said roller member; said face of said inner end of said roller pin abutting said perpendicular surface of said bore of said roller member; a bearing; said bearing includes an inner ring and an outer ring; said staked crown and beveled edge of said outer end of said roller pin securing said inner ring of said bearing to said bearing surface and against said bearing lip of said roller pin permitting said roller member and said roller pin to smoothly rotate with respect to said outer ring of said bearing.

2. A vacuum sweeper brush as claimed in claim 1 wherein said roller pin is cold headed.

3. A vacuum sweeper brush as claimed in claim 1 wherein said outer end of said roller pin includes a knurled bearing surface.

4. A vacuum sweeper brush comprising: a roller member; a roller pin; said roller member having a bore therein; said bore terminating in a perpendicular surface; said roller pin includes an inner end, an outer end, and an intermediate portion; said inner end of said roller pin includes a face and an inner center; said outer end of said roller pin includes an outer center, a bearing lip, a bearing surface, a peened crown, a peened beveled edge, and an axial indentation; said peened crown and said peened beveled edge surround said axial indentation; said intermediate portion of said roller pin includes a knurled outer surface; said inner and outer centers being concentric, plus or minus 0.002 inches; said roller pin residing substantially in said bore of said roller member; said knurled outer surface of said roller pin fixedly securing said roller pin with respect to said roller member; said face of said inner end of said roller pin abutting said perpendicular surface of said bore of said roller member; a bearing; said bearing includes an inner ring and an outer ring; and, said peened crown and beveled edge of said outer end of said roller pin securing said inner ring of said bearing to said bearing surface and against said bearing lip of said roller pin permitting said roller member and said roller pin to smoothly rotate with respect to said outer ring of said bearing.

5. A vacuum sweeper brush as claimed in claim 4 wherein said roller pin is cold headed.

6. A vacuum sweeper brush as claimed in claim 4 wherein said outer end of said roller pin includes a knurled bearing surface.

* * * * *